US006575788B2

(12) United States Patent
Nimura et al.

(10) Patent No.: US 6,575,788 B2
(45) Date of Patent: Jun. 10, 2003

(54) CONNECTOR

(75) Inventors: Kazuhiko Nimura, Yokkaichi (JP); Naoya Kurimoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/109,832

(22) Filed: Mar. 27, 2002

(65) Prior Publication Data

US 2002/0142655 A1 Oct. 3, 2002

(30) Foreign Application Priority Data

Mar. 4, 2001 (JP) ..... 2001-104808

(51) Int. Cl.[7] ..... H01R 13/422
(52) U.S. Cl. ..... 439/595
(58) Field of Search ..... 439/595, 752

(56) References Cited

U.S. PATENT DOCUMENTS 4,986,758 A 1/1991 Wakata
5,769,664 A * 6/1998 Saito et al. ..... 439/595
5,928,034 A * 7/1999 Tabata et al. ..... 439/595
5,944,558 A * 8/1999 Iwahori ..... 439/595
6,165,011 A * 12/2000 Fukuda ..... 439/595
6,179,671 B1 * 1/2001 Ohsumi ..... 439/595
6,332,803 B1 * 12/2001 Matsuda et al. ..... 439/595
6,341,985 B2 * 1/2002 Kodama ..... 439/595

* cited by examiner

*Primary Examiner*—Gary Paumen
(74) *Attorney, Agent, or Firm*—Gerald E. Hespos; Anthony J. Casella

(57) ABSTRACT

A connector has a housing (30) with a retainer (50) that is movable normal to the longitudinal direction of female terminal fittings (20) along the front of a terminal accommodating portion (31) between a partial locking position where the insertion and withdrawal of female terminal fittings (20) are permitted and a full locking position where the female terminal fittings (20) are locked. Jig insertion holes (56) are formed in a front-stop plate (51) of the retainer 50. The female terminal fitting (20) can be withdrawn by inserting a jig through the jig insertion hole (56) to unlock a lock (34) while the retainer (50) is at the partial locking position. The distance between the front-stop plate (5)1 and the locks (34) engaged with the female terminal fittings (20) is short as compared to conventional front-type retainers that move longitudinally. Thus, the locks 34 can be unlocked more easily and the terminal fittings (20) can be easily withdrawn without detaching the retainer (50).

16 Claims, 11 Drawing Sheets

CONNECTOR

BACKGROUND OF THE INVENTION

1. Field of the Invention

The present invention relates to a connector with a retainer.

2. Description of the Related Art

Front-type retainers are mountable on the front of a connector housing and often are used in watertight connectors. Retainers of this type are moved along the longitudinal direction of terminal fittings from a partial locking position, where the terminal fittings can be inserted and withdrawn, to a full locking position where the terminal fittings are locked in the housing.

U.S. Pat. No. 4,986,758 and FIG. 13 herein both show a connector with a front-type retainer. The connector includes a housing with a terminal accommodating portion 1 that has a plurality of cavities 2. Locks 3 project into the cavities 2 and are resiliently deflectable into deflection-permitting spaces 4 adjacent the cavities 2. The connector also has a retainer 5 with a projection 6 and resilient locks 7 aligned with the respective deformation-permitting spaces 4. The retainer 5 can be pushed lightly onto the front of the terminal accommodating portion 1, and can be held at a partial locking position with the projection 6 of the retainer 5 in contact with the front end surface of a terminal accommodating portion 1 and with the resilient locks 7 spaced from the deformation permitting spaces 4. In this state, terminal fittings 8 are insertable into the cavities 2 in the terminal accommodating portion 1. The insertion of the terminal fittings 8 deflects the locks 3 into deflection permitting spaces 4. However, sufficient insertion of the terminal fittings 8 causes the locks 3 to return resiliently to an undeflected condition so that the locks 3 hold the terminal fittings 8 in the respective cavities 2. The retainer then is pushed to a full locking position so that the resilient locks 7 of the retainer 5 enter the deflection-permitting spaces 4, as shown in FIG. 14, to restrict the deformation of the locking portions 3. As a result, the female terminal fittings 8 are locked doubly.

The terminal fittings 8 can be withdrawn while the retainer 5 is in the partial locking position by inserting a jig from the front side of the retainer 5 and deforming the lock 3 in the unlocking direction. However, the front surface of the retainer 5 is spaced a considerable distance from the front of the terminal accommodating portion 1. Thus, the distance to the lock 3 is long and it is not easy to deflect the lock 3 without first removing the retainer 5.

The present invention was developed in view of the above problem and an object thereof is to provide a connector in which terminal fittings can be easily withdrawn without detaching a retainer.

SUMMARY OF THE INVENTION

The invention relates to a connector with a housing. At least one terminal accommodating portion is provided in the housing and is formed with at least one cavity for accommodating a corresponding terminal fitting. At least one resiliently deformable lock is formed in the cavity for releasably locking the terminal fitting. A retainer is mountable on the terminal accommodating portion and is movable along the terminal accommodating portion between a partial locking position where insertion and withdrawal of the terminal fitting are permitted and a full locking position where the terminal fitting is locked in the cavity. A jig insertion hole is formed in the retainer for communicating with the cavity at least when the retainer is at the partial locking position and enabling deflection of the lock in a direction to disengage the lock from the terminal fitting for unlocking.

The terminal fitting can be inserted into the housing with the retainer in the partial locking position, and is partly locked in the cavity by the resiliently deflectable lock. The retainer then is moved to the full locking position for doubly locking the terminal fitting. The mounted terminal fitting can be withdrawn by first moving the retainer from the full locking position to the partial locking position. A jig then is inserted into the jig insertion opening to disengage the lock from the terminal fitting. The retainer is movable from the partial locking position to the full locking position at an angle, and preferably substantially a right angle, to the longitudinal direction of the terminal fitting. Thus, a distance between the front surface of the retainer at the partial locking position and the lock is shorter as compared to retainers that are movable longitudinally. Thus, the lock can be unlocked easily with the jig, and the terminal fitting can be withdrawn easily even without detaching the retainer.

The retainer preferably is mountable at the front end of the terminal accommodating portion and is movable along the front end of the terminal accommodating portion between the partial locking position and the full locking position.

The terminal fitting preferably is a female terminal fitting with a resilient tongue that can be brought into contact with a mating terminal fitting. The retainer preferably is formed with a terminal insertion opening for permitting insertion of the mating terminal fitting. The terminal insertion opening is aligned with the cavity when the retainer is at the full locking position to enable insertion of the mating terminal fitting. However, the terminal insertion opening is not aligned with the cavity when the retainer is at the partial locking position.

The jig may be inserted mistakenly through the terminal insertion opening during the operation of withdrawing the terminal fitting. However, the terminal insertion opening is not aligned with the cavity when the retainer is at the partial locking position. Thus, the resilient tongue of the female terminal fitting cannot be damaged by a mistakenly inserted jig.

The retainer preferably comprises a projection for engaging the terminal fitting sideways when the retainer is moved from the partial locking position to the full locking position. Insertion and withdrawal of the terminal fitting are permitted when the retainer is at the partial locking position because the projection engages the terminal fitting sideways as the retainer is moved from the partial locking position to the full locking position. Further, the projection locks the terminal fitting by the direct engagement with the terminal fitting when the retainer is at the full locking position. Thus, the terminal fitting can be locked more securely. Still further, the connector housing preferably has guiding means for guiding insertion of the projection of the retainer.

The retainer is insertable into the connector housing at an angle, and preferably substantially a right angle to the insertion direction of the terminal fitting into the corresponding cavity.

The retainer and the housing preferably have cooperating locking means for locking the retainer in either the partial locking position and the full locking position.

A sealing packing may be provided between the housing and a mating housing of the mating connector for providing a sealing function. The retainer preferably holds the sealing packing at the housing at least when the retainer is at the full locking position.

The connector also may comprise a sealing plug with at least one wire insertion opening to enable insertion of the respective female terminal fittings. The sealing plug can be brought into close contact with wires mounted on the respective female terminal fittings, and is mountable in a sealing plug accommodating portion of the housing for providing a sealing function.

The connector further may comprise a receptacle for at least partly surrounding the terminal accommodating portion. The receptacle preferably comprises a sealing plug portion for holding and/or pressing the sealing plug in the sealing plug accommodating portion.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 2:
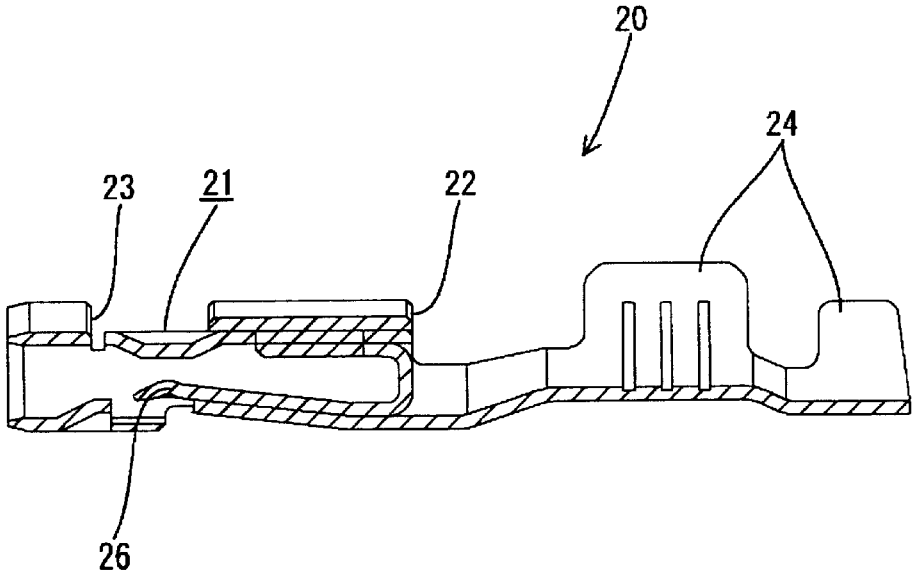
FIG. 2 is a vertical section of a formed female terminal fitting.
Figure 3:
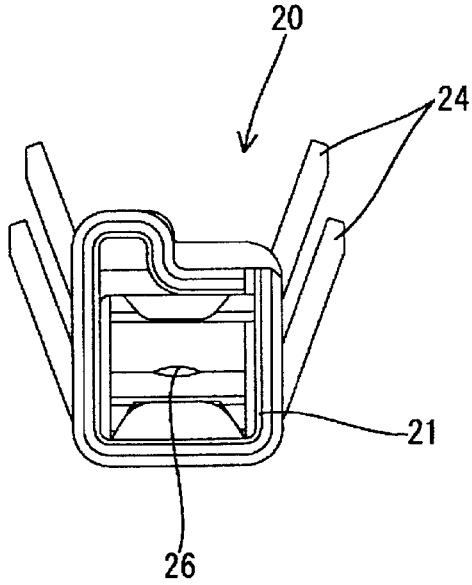
FIG. 3 is a front view of the female terminal fitting.

A watertight female connector in accordance with the invention comprises one or more locking female terminal fittings 20, as shown in FIGS. 2 and 3. Each female terminal fitting 20 has a rectangular tubular connecting portion 21 for connection with a male terminal fitting and barrels 24 for crimped connection with a wire 25. A resiliently deformable tongue 26 is provided inside the connecting portion 21 and is connectable with the male terminal fitting. The connecting portion 21 has one lateral side higher than the other (FIG. 3), and has a jaw 22 at the rear edge. A locking groove 23 is formed near the leading end of the upper surface of the connecting portion 21.

Figure 1:
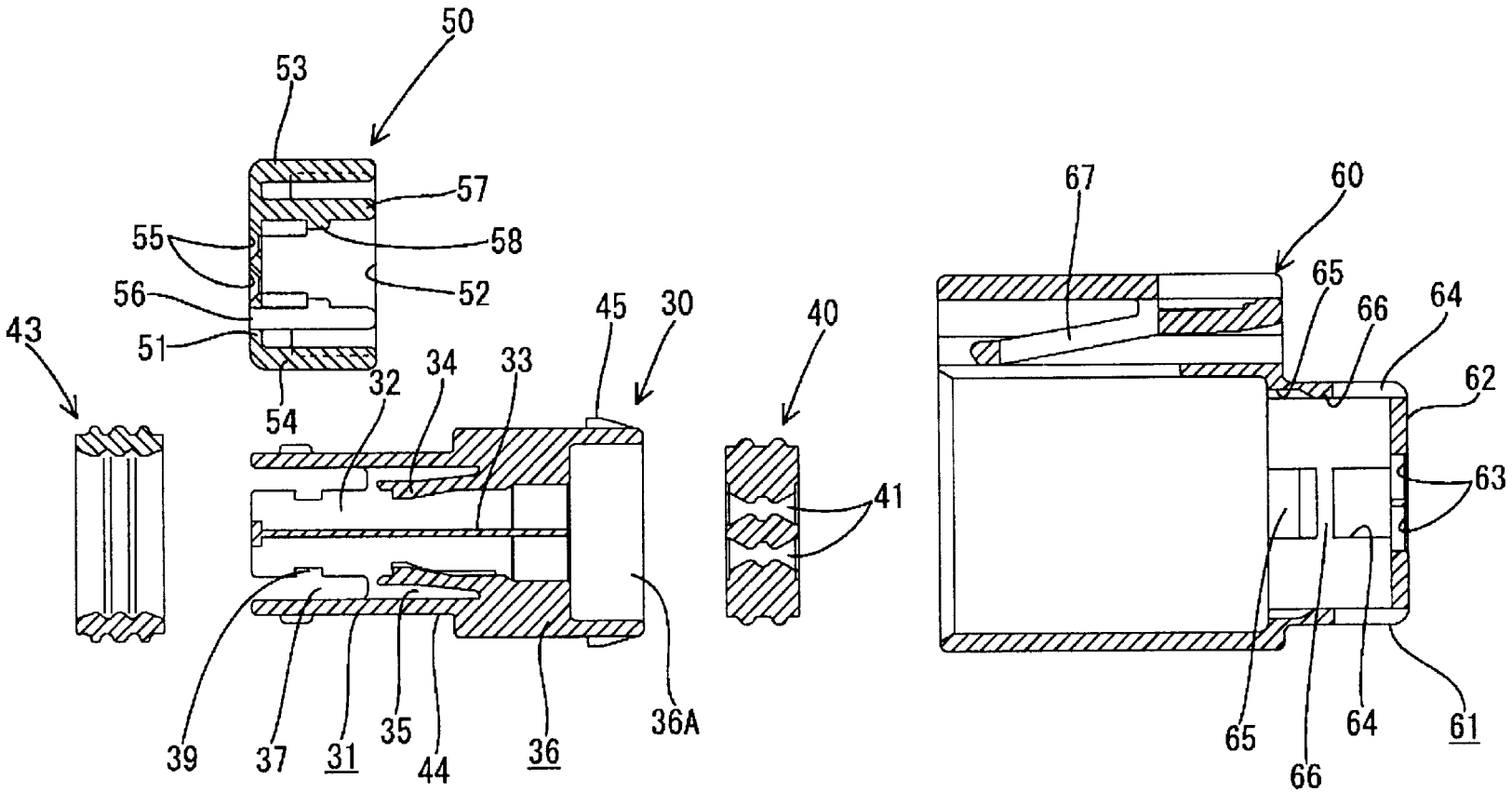
FIG. 1 is an exploded longitudinal section of a connector according to one embodiment.
Figure 4:
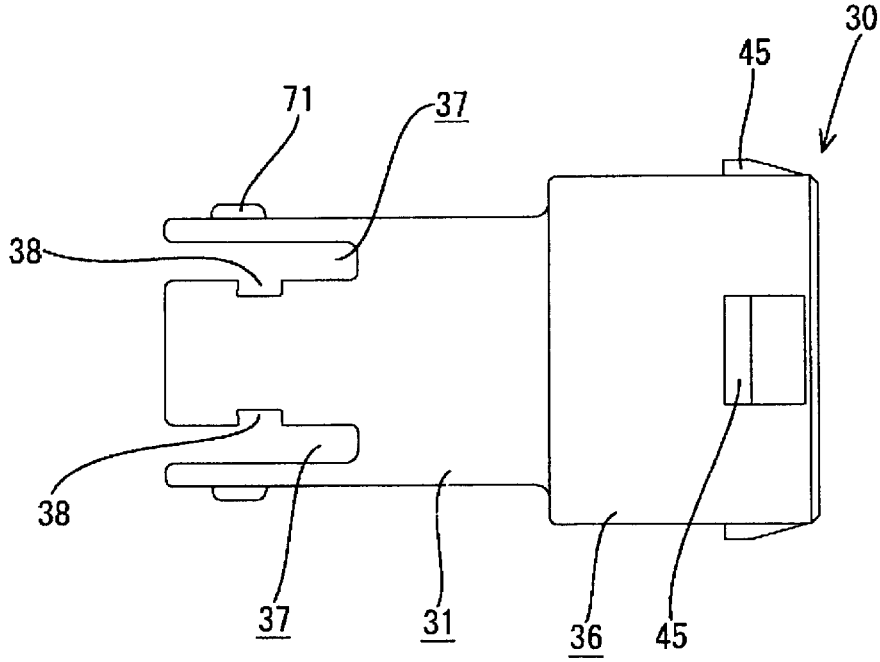
FIG. 4 is a side view of a housing.

The connector further includes a housing, as shown in FIGS. 1 and 4. The housing 30 is made e.g. of a synthetic resin and has opposite front and rear ends. A forwardly open terminal accommodating portion 31 is formed at the front end and a plug accommodating portion 36, which is larger than the terminal accommodating portion 31, is formed at the rear end. Cavities 32 penetrate the terminal accommodating portion 31 in forward and backward directions and are dimensioned to accommodate the female terminal fittings 20. The cavities 32 are substantially side by side at two stages, and are partitioned by cavity walls 33. Locks 34 are provided in the upper and lower cavities 32 for engagement with the female terminal fittings 20. Upper cavities 32 have the locks 34 formed at the ceiling surfaces while lower cavities 32 have locks 34 at the bottom surfaces. Each lock 34 is cantilevered and is resiliently deformable toward a deflection permitting space 35 adjacent the respective.

A plug chamber 36A is formed in the rear of the plug accommodating portion 36 and communicates with the entrances to the respective cavities 32. The plug chamber 36A closely accommodates at least part of a one-piece rubber plug 40. Wire insertion openings 41 are formed in the rubber plug 40 and are substantially concentric with the corresponding cavities 32. The wire insertion openings 41 enable insertion of the respective female terminal fittings 20 and can be brought into close contact with the wires 25.

Figure 7:
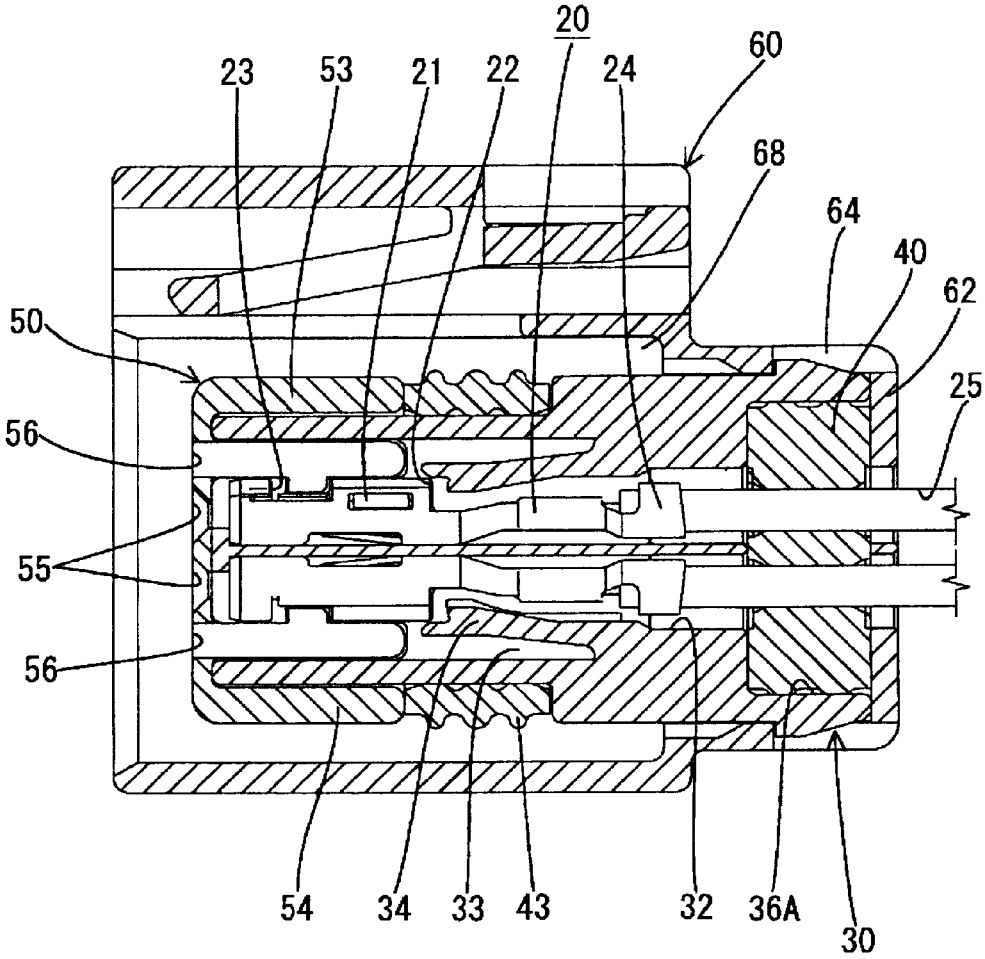
FIG. 7 is a longitudinal section of the connector showing a state where the retainer is at a partial locking position.
Figure 10:
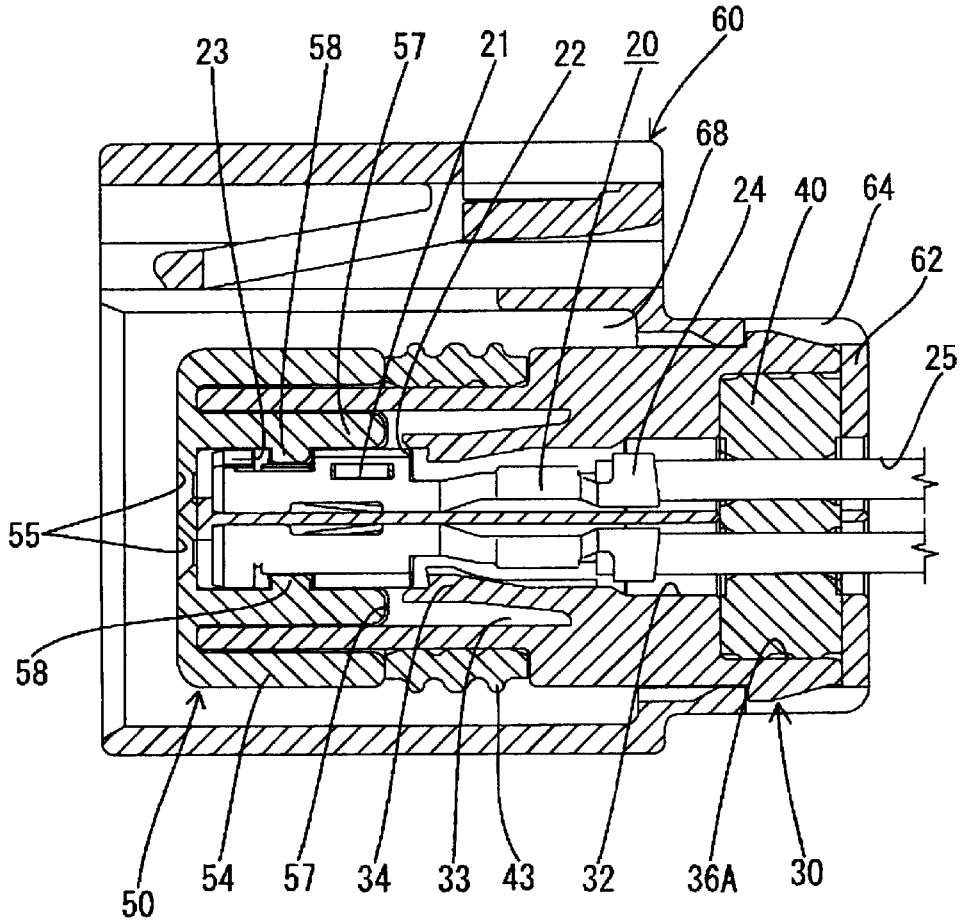
FIG. 10 is a longitudinal section of the connector showing a state where the retainer is at a full locking position.

The connector also includes a rectangular tubular receptacle 60 made of a synthetic resin. The receptacle is dimensioned to cover at least part of the terminal accommodating portion 31 so that a connection space 68 for a mating male connector is defined around the housing 30, as shown in FIGS. 1, 7 and 10. A rear end of the receptacle 60 is smaller than a front part thereof and serves as a coupling base 61 for the housing 30. A plug pressing wall 62 is formed on the rear surface of the coupling base 61. The plug pressing wall 62 has apertures 63 that substantially correspond to the entrances of the respective cavities 32 and enable insertion of the female terminal fittings 20.

The housing 30 is inserted into the open front of the receptacle 60. The housing 30 has locking projections 45 that project substantially in the widthwise centers of the rear ends of the four surfaces of the rubber plug accommodating portion 36. The rear surfaces of the respective locking projections 45 are slanted. On the other hand, locking grooves 64 are formed in the corresponding four surfaces of the coupling base 61 of the receptacle 60 and align with locking projections 45. Shallow escape grooves 65 are formed between the locking grooves 64 and the front end and tapered lock-effecting portions 66 are between the locking grooves 64 and the escape grooves 65. The locking projections 45 enter the escape grooves 65 when the housing 30 is inserted up to the coupling base 61 of the receptacle 60. The slanted surfaces of the locking projections 45 cooperate with the tapered lock-effecting portions 66 and enable the locking projections 45 to fit in and lock with the locking grooves 64. As a result, the housing 30 and the receptacle 60 are assembled into a single unit. At this time, the rubber plug 40 faces the plug pressing wall 62 and is prevented from coming out.

A resiliently deformable lock arm 67 is provided substantially in the widthwise center of the upper surface of the receptacle 60 for locking the female housing 30 into the mating male connector.

The packing 43 for sealing between the male connector housing and the housing 30 is held in contact with a stepped surface 44 on a rear part of the outer surface of the terminal accommodating portion 31.

A retainer insertion hole 37 is formed at the front of the terminal accommodating portion 31 and penetrates from one side surface of the terminal accommodating portion 31 to the other. The retainer insertion hole 37 is divided into an upper section and a lower section that intersect the cavities 32 of the upper and lower stages. The cavity walls 33 that partition the respective cavities 32 are formed with projection insertion grooves 38 at positions that correspond to the locking grooves 23 when the female terminal fittings 20 are mounted properly in the cavities 32.

Figure 6:
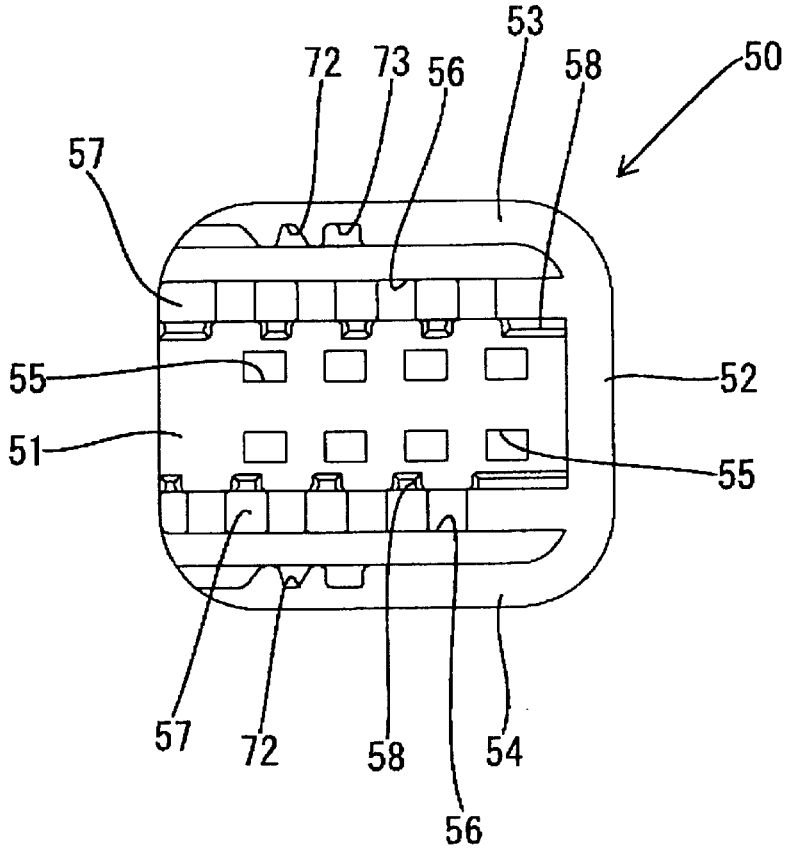
FIG. 6 is a rear view of a retainer.

The connector also includes a retainer 50 that is made of a synthetic resin. The retainer 50, as shown in FIGS. 1 and 6, has a front-stop plate 51 for covering the front surface of the terminal accommodating portion 31, a second side plate 52 for covering the left side when viewed from the front, an upper plate 53 and a bottom plate 54. The right surface when viewed from front is open. The front-stop plate 51 functions as a stopper for stopping the female terminal fittings 20 inserted into the cavities 32.

Figure 5:
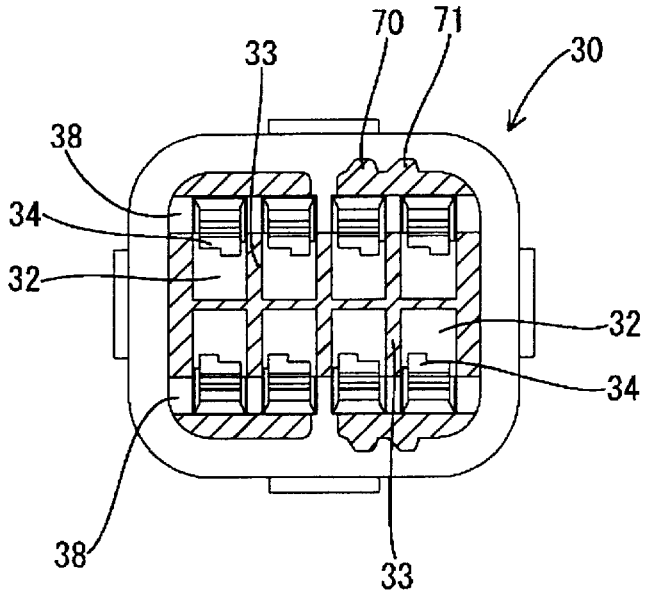
FIG. 5 is a lateral section of the housing.
Figure 8:
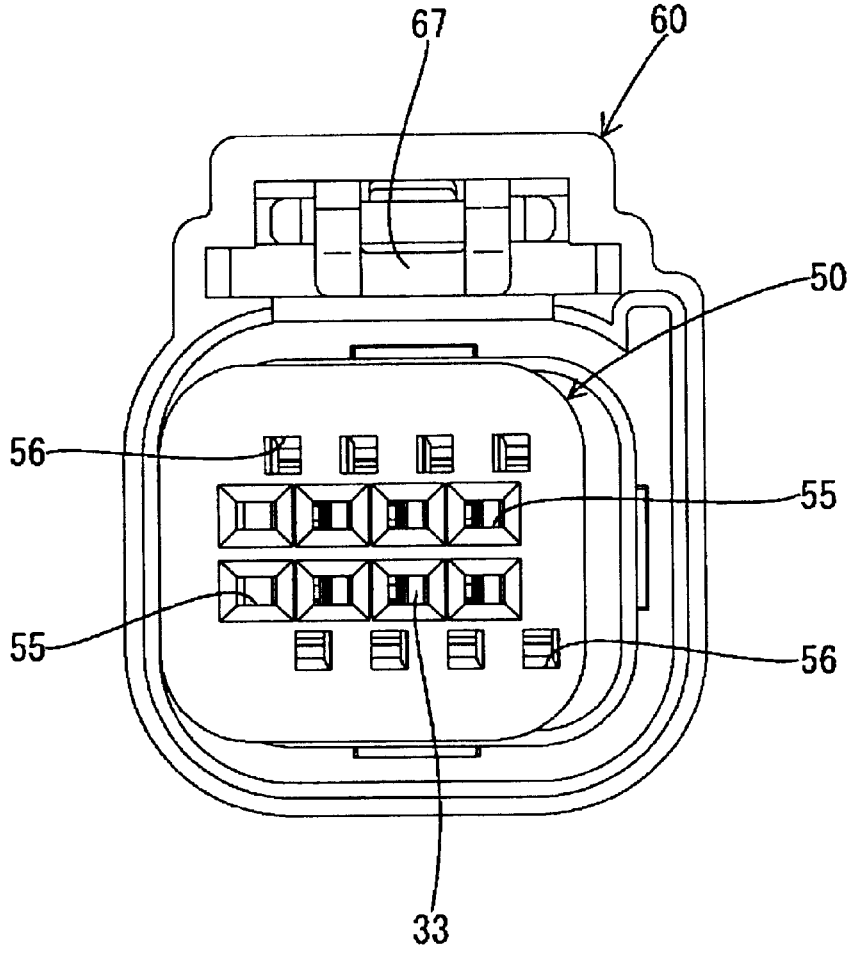
FIG. 8 is a front view of the connector in the state shown in FIG. 7.
Figure 9:
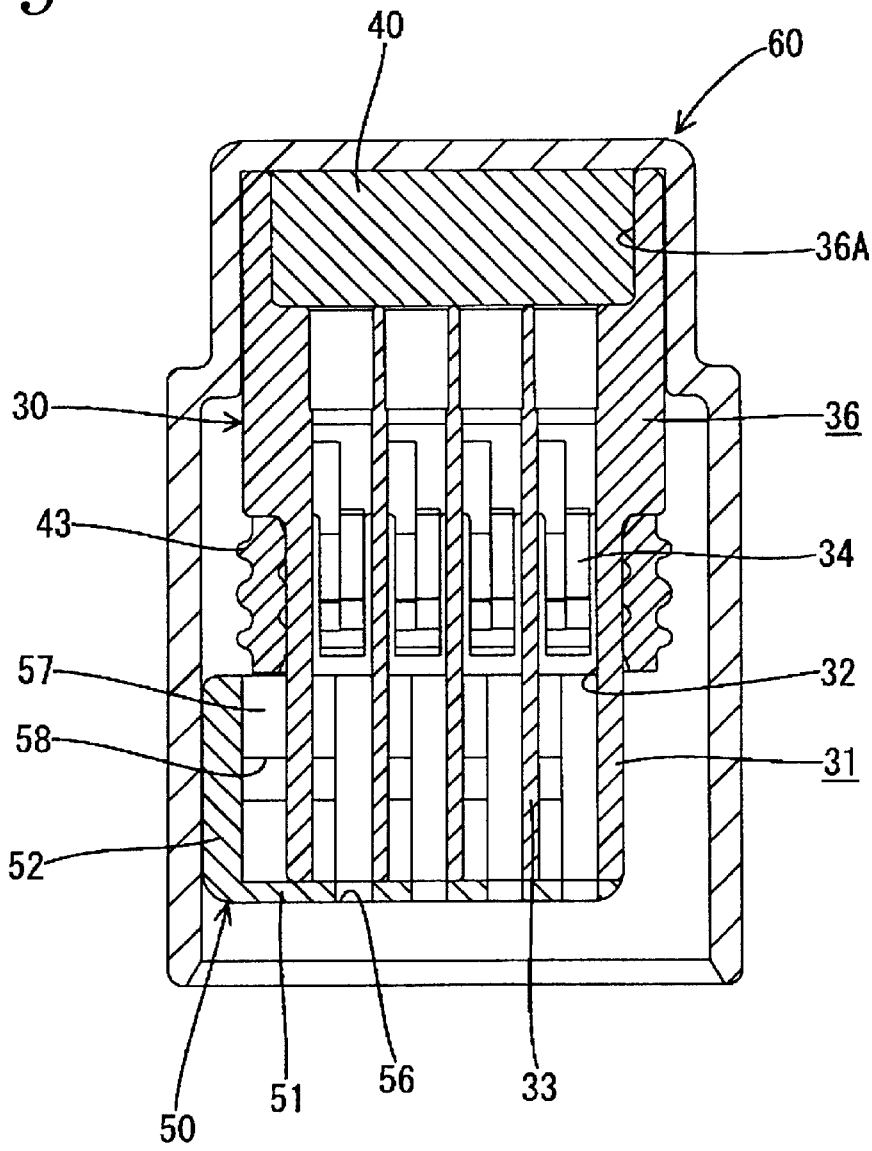
FIG. 9 is a plan view in section of the connector in the state shown in FIG. 7.

The retainer 50 is mountable on the terminal accommodating portion 31 at a partial locking position and full locking position. Partial and full locking projections 70 and 71 are formed at transversely spaced apart positions on the right side of each of the upper and lower surfaces of the terminal accommodating portion 31, as shown in FIG. 5. On the other hand, the retainer 50 has a first and second locking grooves 72 and 73 that are formed at side positions on the inner surface of each of the upper and lower plates 53 and 54, as shown in FIG. 6, for engagement with the corresponding partial and full locking projections 70, 71. Thus, the retainer 50 can be inserted laterally into the retainer insertion hole 37 along the front surface of the terminal accommodating portion 31 so that the partial locking projections 70 fit into the first locking grooves 72 to hold the retainer 50 at the partial locking position (see FIGS. 7 to 9). In this state, the retainer 50 is offset to the left with respect to the front surface of the terminal accommodating portion 31, as shown in FIG. 9. The retainer 50 can be pushed further so that the partial locking projections 70 fit into the second locking grooves 73 and the full locking projections 71 fit into the first locking grooves 72 to hold the retainer 50 at the full locking position (see FIGS. 10 to 12).

The front-stop plate 51 has locking plates 57 at each of the upper and lower stages to align with the respective cavities 32. The locking plates 57 have leading ends that reach a position before the locks 34. A projection 58 is formed substantially at the center of the inner surface of each locking plate 57 with respect to the depth direction. The projections 58 can enter the locking grooves 23 of the female terminal fittings 20 sideways for locked engagement.

The projections 58 are at lateral sides of the respective cavities 32 and fit in the projection insertion grooves 38 in the cavity walls 33 when the retainer 50 is at the partial locking position to permit insertion and withdrawal of the female terminal fittings 20. However the projections 58 enter the corresponding cavities 32 to engage the locking grooves 23 of the female terminal fittings 20, when the retainer 50 is moved to the full locking position, thereby locking the female terminal fittings 20 in the cavities 32.

The front-stop plate 51 has jig insertion holes 56 formed between the locking plates 57 at each of the upper and lower stages. Terminal insertion openings 55 are formed at each of the two stages and correspond to the respective cavities 32 for permitting the insertion of the male terminal fittings. When the retainer 50 is at the partial locking position, the respective jig insertion openings 56 at the upper stage are at the upper left sides of the corresponding cavities 32 and those at the lower stage are at the lower right sides of the corresponding cavities 32. Thus, a jig can be inserted to disengage the lock 34 from the female terminal fitting 20. Contrary to this, the terminal insertion openings 55 are offset laterally from the corresponding cavities 32 so that the female terminal fittings 20 in the cavities 32 are substantially concealed. When the retainer 50 is at the full locking position, the terminal insertion openings 55 align substantially with the corresponding cavities 32 to enable the insertion of the male terminal fittings for connection.

The connector is assembled by first mounting the packing 43 on the stepped surface 44 of the housing 30 and fitting the rubber plug 40 into the plug chamber 36A. The locking plates 57 and the projections 58 of the retainer 50 then are aligned with the retainer insertion hole 37 and the projection insertion grooves 38. The retainer 50 then is inserted into the retainer insertion hole 37 laterally from left when viewed from the front. The first locking grooves 72 move substantially along the front end surface of the terminal accommodating portion 31 and engage the partial locking projections 70 on the housing 30 to mount the retainer 50 at the partial locking position. At this position, the retainer 50 is offset laterally from the terminal accommodating portion 31 and the respective projections 58 are at lateral positions relative to the corresponding cavities 32 (see FIG. 9). The respective terminal insertion openings 55 also are offset from the corresponding cavities 32 (see FIG. 8).

Assembly proceeds by fitting the housing 30 into the receptacle 60 from the front. The housing 30 is pushed until the rear end of the plug accommodating portion 36 contacts the plug pressing wall 62. This pushing causes the locking projections 45 to slide along the escape grooves 65, move over the lock-effecting portions 66 and engage the locking grooves 64. As a result, the receptacle 60 and the housing 30 are assembled integrally. In addition, the rubber plug 40 is locked by the plug pressing wall 62.

The female terminal fittings 20 then are inserted through the apertures 63 in the receptacle 60 and into the cavities 32 by widening the wire insertion openings 41 of the rubber plug 40. The female terminal fittings 20 resiliently deflect the locks 34 into the deflection permitting spaces 35 and are pushed to their proper positions without interference from the projections 58. The locks 34 then are restored resiliently to engage the jaws 22 to achieve partial locking, as shown in FIG. 7. Further, the inner surfaces of the wire insertion openings 41 of the rubber plug 40 closely contact the outer surfaces of the wires 25 to provide sealing.

Figure 11:
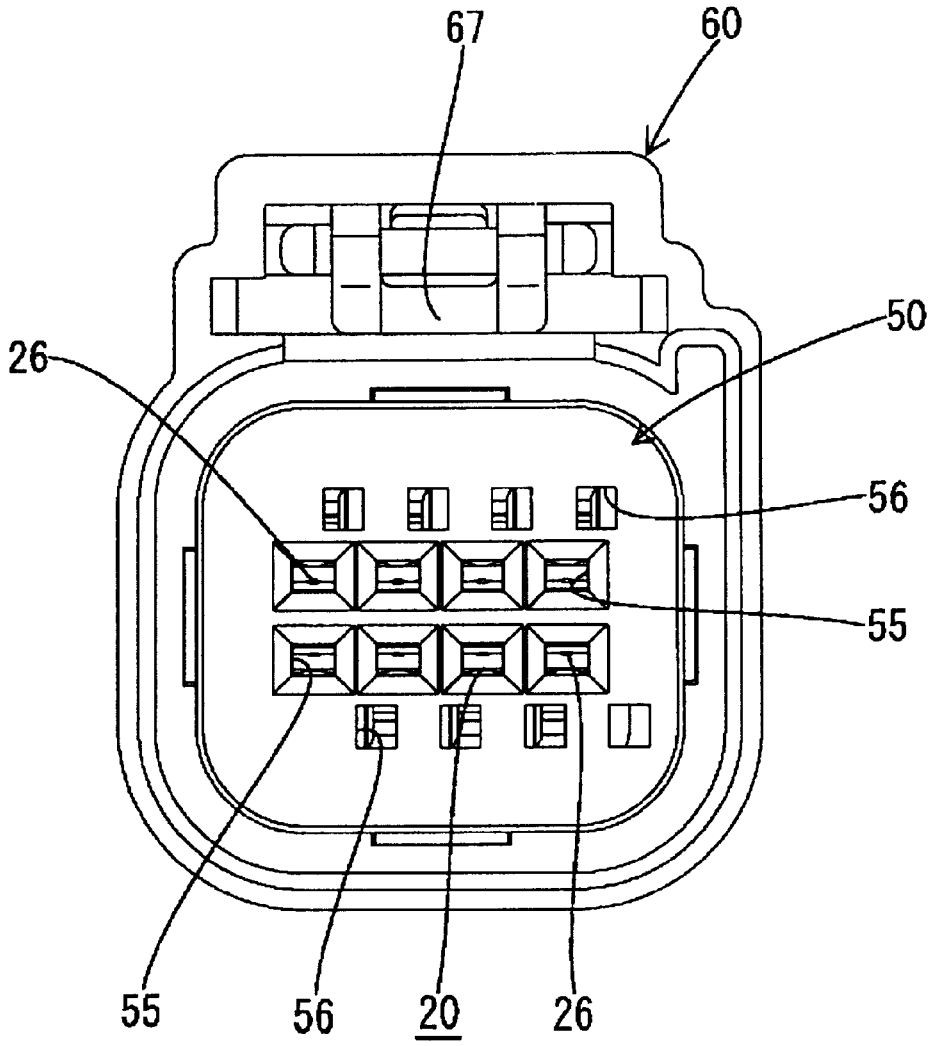
FIG. 11 is a front view of the connector in the state shown in FIG. 10.
Figure 12:
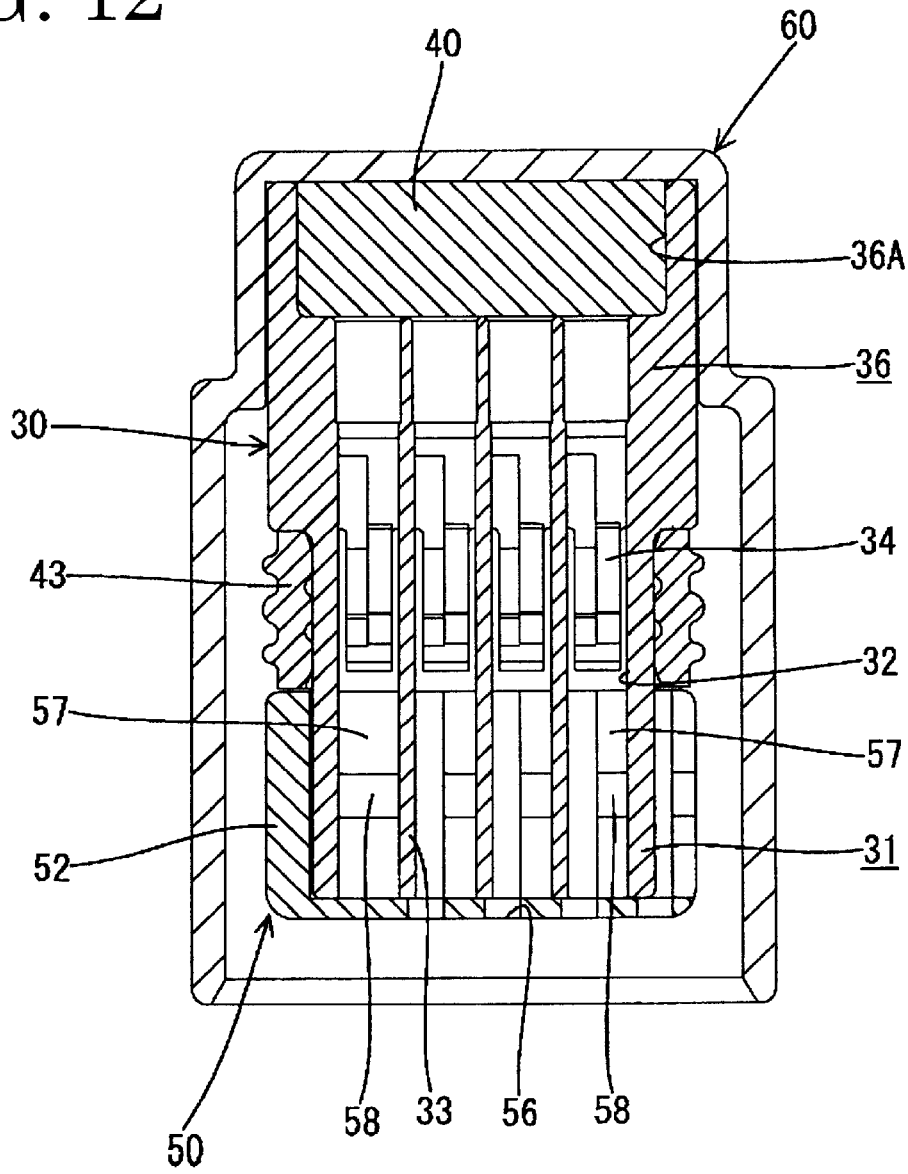
FIG. 12 is a plan view in section of the connector in the state shown in FIG. 10.
Figure 13:
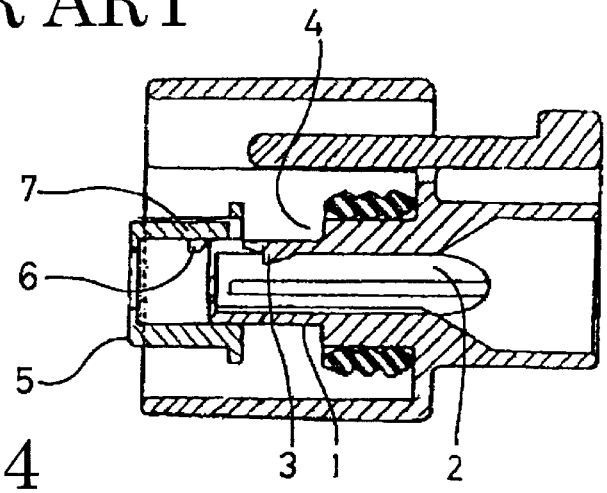
FIG. 13 PRIOR ART
FIG. 13 is a longitudinal section of a prior art connector showing a state where a retainer is at a partial locking position.
Figure 14:
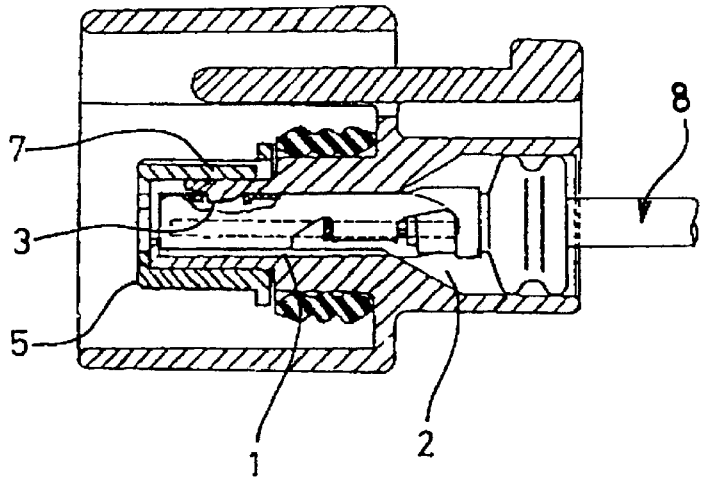
FIG. 14 PRIOR ART
FIG. 14 is a longitudinal section of the connector showing a state where the retainer is at a full locking position.

Finally, the retainer 50 is moved laterally along the front end of the terminal accommodating portion 31 to engage the second locking grooves 73 with the partial locking projections 70 of the housing 30 and the first locking grooves 72 with the full locking projections 71, thereby locking the retainer 50 at the full locking position shown in FIGS. 10 to 12. The projections 58 of the retainer 50 enter the corresponding cavities 32 to engage the locking grooves 23 of the female terminal fittings 20. Thus, the female terminal fittings 20 are locked doubly by the direct engagement of the projections 58 and the locks 34. Further, the terminal insertion openings 55 substantially align with the front surfaces of the corresponding cavities 32, as shown in FIG. 11, so that the mating male terminal fittings can be inserted.

The assembled female connector can be connected with the mating male connector so that tabs of the male terminal fittings connect with the resilient tongues 26 of the female terminal fittings 20. The female and male connectors are locked to each other by the lock arm 67 and sealing is provided between the two connector housings by the packing 43.

The female terminal fittings 20 can be withdrawn by first disconnecting the male and female connectors and then moving the retainer 50 from the full locking position to the partial locking position. At the partial locking position, the projections 58 are disengaged from the locking grooves 23 of the female terminal fittings 20 and are displaced to the left sides of the cavities 32, as described above. The jig then can be inserted through the jig insertion hole 56 in the front-stop plate 51 of the retainer 50. The jig insertion holes 56 communicate with portions of the respective cavities 32 aligned with the locks 34. Thus, the lock 34 can be deflected by the jig into the deflection permitting space 35 and disengaged from the jaw 22 of the female terminal fitting 20. The female terminal fitting 20 then can be withdrawn.

As described above, the retainer 50 can be moved along the front of the terminal accommodating portion 31 substantially normal to the insertion direction of the female terminal fittings 20 into the respective cavity 32 between the partial locking position and the full locking position. Thus, the distance between the front-stop plate 51 and the locks 34 is short as compared to conventional front-type retainers that move in a longitudinal direction. Therefore, the lock 34 can be unlocked more easily even if the jig is inserted through the jig insertion hole 56 in the front-stop plate 51, and the female terminal fitting 20 can be withdrawn easily without detaching the retainer 50.

The terminal insertion openings 55 in the front-stop plate 51 are offset from the front surfaces of the cavities 32 when the retainer 50 is at the partial locking position. Thus, even if the jig is mistakenly inserted into the terminal insertion opening 55 to withdraw the female terminal fitting 20, the jig will not contact and damage the resilient tongue 26 of the female terminal fitting 20.

The invention is not limited to the above described and illustrated embodiment. For example, the following embodiments also are embraced by the present invention as defined in the claims. Beside the following embodiments, various changes can be made without departing from the scope and spirit of the present invention as defined in the claims.

The assembly procedure described above is only one example. The packing 43, the retainer 50 and the one-piece rubber plug 40 may be mounted on the housing 30 in other procedures. For example, the rubber plug 40 can be mounted after the packing 43 and the retainer 50 are mounted.

The present invention is similarly applicable to male connectors.

The invention also is applicable to connectors with no receptacle 60.

The invention was described with respect to an embodiment with the terminal fittings 20 arranged at two stages. However, the invention also is applicable to connectors with only one terminal fitting or with terminal fittings arranged on single stage or on three or more stages.

What is claimed is:

1. A connector, comprising:

a housing, at least one terminal accommodating portion in the housing and formed with at least one cavity for at least partly accommodating a corresponding terminal fitting, at least one resiliently deformable lock in the cavity for releasably locking the terminal fitting, a retainer mountable at the terminal accommodating portion and movable along the terminal accommodating portion between a partial locking position where the insertion and withdrawal of the terminal fitting are permitted and a full locking position where the terminal fitting is held in the cavity, the retainer being mountable at a front end of the terminal accommodating portion and movable along the front end of the terminal accommodating portion between the partial locking position and the full locking position, the retainer being insertable into the housing substantially normal to an insertion direction of the terminal fitting into the corresponding cavity, and a jig insertion hole in the retainer and communicating with the cavity when the retainer is at the partial locking position and enabling a deflection of the lock in a direction to disengage the lock from the terminal fitting.

2. The connector of claim 1, wherein the terminal fitting is a female terminal fitting with a resilient tongue configured for contacting a mating terminal fitting.

3. The connector of claim 2, wherein the retainer is formed with a terminal insertion opening for permitting the insertion of the mating terminal fitting, the terminal insertion opening being substantially aligned with the cavity to enable connection of the mating terminal fitting and the terminal fitting when the retainer is at the full locking position while being misaligned therewith when the retainer is at the partial locking position.

4. The connector of claim 1, wherein the retainer comprises at least one projection for engaging the terminal fitting when the retainer is moved from the partial locking position to the full locking position.

5. The connector of claim 4, wherein the housing comprises guiding means for guiding the insertion of the projection of the retainer.

6. The connector of claim 1, wherein the retainer and the housing comprise interengageable locking means for locking the retainer in the partial locking position and the full locking position.

7. The connector of claim 1, further comprising a sealing packing between the housing and a mating housing of the mating connector for providing a sealing function, the retainer holding the sealing packing at the housing at least when the retainer is at the full locking position.

8. The connector of claim 1, further comprising a sealing plug having at least one wire insertion opening to enable insertion of the respective female terminal fittings and to contact the wires mounted on the respective female terminal fittings, the sealing plug being mountable into a sealing plug accommodating portion of the housing for providing a sealing function.

9. The connector of claim 1, further comprising a receptacle for at least partly surrounding the terminal accommodating portion.

10. The connector of claim 9, wherein the receptacle comprises a plug wall for pressing the sealing plug at least partly mounted in the plug accommodating portion.

11. A connector, comprising:

a housing with a terminal accommodating portion having opposite front and rear ends and at least one cavity extending in a longitudinal direction between the front and rear ends for accommodating a corresponding terminal fitting, at least one resiliently deformable lock in the cavity for releasably locking the terminal fitting, a retainer mountable to the front end of the terminal accommodating portion and movable along the front end of the terminal accommodating portion in a direction substantially normal to the longitudinal direction of the cavity between a partial locking position where insertion and withdrawal of the terminal fitting are permitted and a full locking position where the terminal fitting is held in the cavity, and a jig insertion hole in the retainer and communicating with the cavity when the retainer is at the partial locking position and enabling a deflection of the lock in a direction to disengage the lock from the terminal fitting.

12. The connector of claim 11, wherein the retainer is formed with a terminal insertion opening for permitting the insertion of a mating terminal fitting, the terminal insertion opening being substantially aligned with the cavity to enable connection of the mating terminal fitting and the terminal fitting when the retainer is at the full locking position while being misaligned therewith when the retainer is at the partial locking position.

13. The connector of claim 12, wherein the retainer comprises at least one projection for engaging the terminal fitting when the retainer is moved from the partial locking position to the full locking position.

14. The connector of claim 11, wherein the retainer and the housing comprise interengageable locking means for locking the retainer in the partial locking position and the full locking position.

15. The connector of claim 11, further comprising a sealing packing between the housing and a mating housing of the mating connector for providing a sealing function, the retainer holding the sealing packing at the housing at least when the retainer is at the full locking position.

16. The connector of claim 15, further comprising a sealing plug having at least one wire insertion opening to enable insertion of the respective female terminal fittings and to contact the wires mounted on the respective female terminal fittings, the sealing plug being mountable into a sealing plug accommodating portion of the housing for providing a sealing function.

* * * * *